US007033145B2

(12) United States Patent
Iacocca

(10) Patent No.: US 7,033,145 B2
(45) Date of Patent: Apr. 25, 2006

(54) CENTRIFUGAL PUMP FOR ELECTRICAL HOUSEHOLD APPLIANCE OR THE LIKE

(75) Inventor: Sabino Iacocca, Asti (IT)

(73) Assignee: Plaset, S.p.A., (IT)

( * ) Notice: Subject to any disclaimer, the term of this patent is extended or adjusted under 35 U.S.C. 154(b) by 91 days.

(21) Appl. No.: 10/723,295

(22) Filed: Nov. 26, 2003

(65) Prior Publication Data

US 2005/0111992 A1 May 26, 2005

(51) Int. Cl.
*F16B 35/04* (2006.01)
*F16B 1/02* (2006.01)

(52) U.S. Cl. ..... 417/325; 417/326; 417/423.6

(58) Field of Classification Search ..... 417/325, 417/326, 423.1, 423.6; 415/216.1; 416/244 R, 416/244 A, 204 R, 204 A
See application file for complete search history.

(56) References Cited

U.S. PATENT DOCUMENTS

| | | | | |
|---|---|---|---|---|
| 6,478,555 | B1 * | 11/2002 | Kim et al. | 417/420 |
| 6,524,078 | B1 * | 2/2003 | Brooks et al. | 417/223 |
| 2002/0122731 | A1 * | 9/2002 | Marioni | 417/352 |

FOREIGN PATENT DOCUMENTS

| | | | |
|---|---|---|---|
| DE | 4232939 | A1 | 4/1994 |
| EP | 0207430 | | 2/1992 |
| EP | 0514272 | A1 | 11/1992 |
| EP | 514272 | A1 * | 11/1992 |
| EP | 0287984 | | 10/1993 |
| EP | 0945622 | A1 | 9/1999 |
| WO | WO9935403 | A1 | 7/1999 |
| WO | WO9948189 | A1 | 9/1999 |

OTHER PUBLICATIONS

European Search Report for European Patent Application EP03019974.9-2315, Feb. 8, 2005.

* cited by examiner

*Primary Examiner*—Charles G. Freay
(74) *Attorney, Agent, or Firm*—Locke Liddell & Sapp LLP

(57) ABSTRACT

A centrifugal pump for a household appliance includes a synchronous alternating current electrical motor having a permanent magnet rotor and a bladed impeller coupled to an end of the rotor which extends into a cavity in the hub thereof. The rotor and the hub are provided with transverse coupling formations, respectively, which have angular extensions with angular play between the rotor and the impeller for promoting the starting of the motor. The rotor coupling formation includes a transverse appendage on a rigid drive body secured to the rotor, and a resilient damping formation molded onto the drive body and having two end portions for engaging the impeller coupling formation, and an intermediate portion which interconnects the end portions and extends at least partially through the drive body so that the damping formation as a whole is constrained axially and angularly on the drive body.

12 Claims, 7 Drawing Sheets

CENTRIFUGAL PUMP FOR ELECTRICAL HOUSEHOLD APPLIANCE OR THE LIKE

FIELD OF THE INVENTION

The present invention relates in general to pumps, particularly for use in electrical household appliances and the like and more specifically, to a centrifugal pump.

BACKGROUND OF THE PRESENT DISCLOSURE

A centrifugal pump of that type is described, for example, in European patent EP-0 207 430-B1. In one embodiment which is illustrated, in particular, in FIG. 13 of that document, the coupling formation of the rotor is constituted by a curved region of resilient material, the radially outermost surface of which has toothing. This region of resilient material is inserted axially into an annular cavity in the rotor, the radially outermost surface of which is provided with corresponding toothing. This solution requires an accurate construction of the resilient region and of the corresponding toothing of the rotor. The insertion of the resilient region into the rotor requires fairly precise relative angular positioning in order to prevent interference during insertion. In addition, the resilient region is not constrained in a stable manner on the rotor, in particular in the axial direction.

In an alternative solution described in European patent EP-0 287 984-B1, a quantity of viscous fluid, such as an oil or a grease having lubricating properties, is placed and sealed in the cavity of the impeller hub and is intended to damp the impact between the coupling formations of the impeller and of the rotor and to muffle the noise correspondingly generated. This solution is difficult to put into practice and presents problems from the point of view of maintaining the sealed isolation of the viscous fluid in the cavity of the impeller.

SUMMARY OF THE PRESENT DISCLOSURE

A centrifugal pump includes a support casing including a body and a volute which are coupled to one another to define a working chamber, a synchronous electrical motor driven by alternating current, having a stator which is stationary relative to the body, and having a permanent magnet rotor which is rotatable in the body, and a bladed impeller mounted rotatably in the working chamber and provided with a hub which has a cavity; the impeller being coupled to an end of the rotor which extends into the cavity of the hub of the impeller.

The end of the rotor and the hub of the impeller is provided with a first and a second transverse coupling formation, respectively, which have respective angular extensions which are predetermined in such a manner that there is angular play, suitable for promoting the starting of the motor, between the rotor and the hub of the impeller; the formations being capable of interfering with one another, after the motor has started, in order to bring about the drive of the impeller by the rotor.

The portions of the coupling formation of the rotor that are to cooperate with the coupling formation of the impeller being produced from a resilient material.

The object of the present invention is to propose an alternative construction which enables the disadvantages outlined above of the solutions according to the prior art in the Background Section of the present disclosure to be overcome.

That and other objects are achieved according to the invention with a centrifugal pump of the type specified above, characterized in that the coupling formation of the rotor comprises a substantially radial transverse appendage which extends from and is integral with a drive body of substantially rigid material which is secured to the rotor, and a damping formation which is molded in a single piece of resilient material onto the drive body and has two end portions which are molded onto the opposite surfaces or faces of the appendage and which are to cooperate with the coupling formation of the impeller, and also an intermediate connecting and retaining portion which interconnects the end portions and extends at least partially through the drive body in such a manner that the damping formation is constrained in a stable manner, axially and angularly, on the drive body.

BRIEF DESCRIPTION OF THE DRAWINGS

Further characteristics and advantages of the invention will emerge from the following detailed description which is given purely by way of non-limiting example with reference to the appended drawings in which.

DETAILED DESCRIPTION

Figure 1:
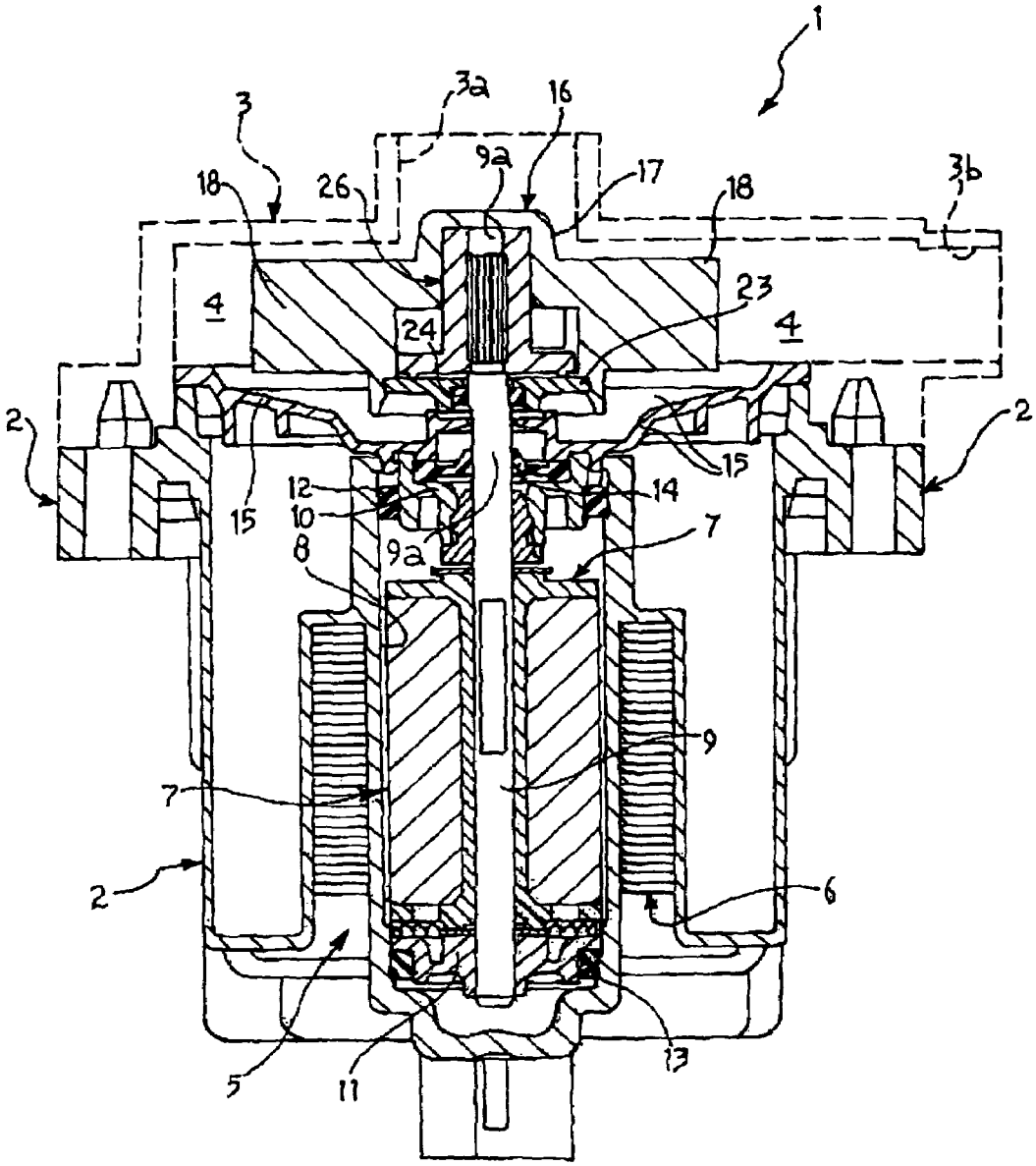
FIG. 1 is a view in axial section of a centrifugal pump according to the invention.

In FIG. 1, a centrifugal pump according to the invention is generally indicated 1.

In a manner known per se, the pump 1 comprises a support casing including a shaped body 2 and a volute 3 (illustrated with broken lines) which are coupled to one another to define a working chamber 4.

The volute 3 forms an axial suction passage 3*a* and a lateral outlet or delivery passage 3*b*.

The pump 1 comprises a synchronous electrical motor driven by alternating current and generally indicated 5. In a manner known per se, the motor 5 comprises a stator 6 which is stationary relative to the body 2, and a permanent magnet rotor 7 mounted rotatably in that body.

In the embodiment illustrated by way of example, the body 2 forms a central cylindrical chamber 8 in which the rotor 7 of the electrical motor 5 is rotatably accommodated. The rotor has a central shaft 9, the upper and lower ends of which extend rotatably in corresponding supports 10 and 11 which are mounted in the chambers of the body 2 with the interposition of respective toric sealing rings 12 and 13.

The upper end 9*a* of the shaft 9 of the rotor 7 extends as far as into the working chamber 4, passing through an annular lip seal 14 which is clasped between the upper support 10 and an upper separating element 15 which is substantially in the shape of a crater.

The pump 1 also comprises a bladed impeller 16 mounted rotatably in the working chamber 4 and coupled to the upper end 9*a* of the rotor 9 of the electrical motor 5.

Figure 2:
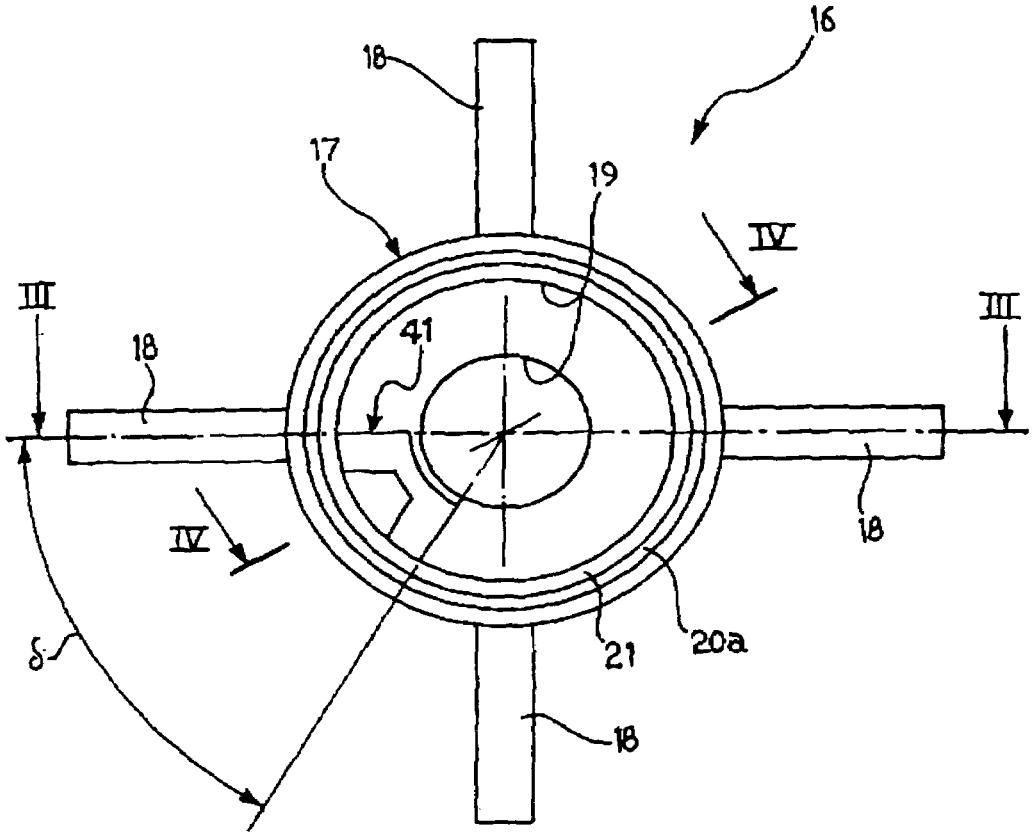
FIG. 2 is a plan view from below of the impeller of the pump according to FIG. 1.
Figure 3:
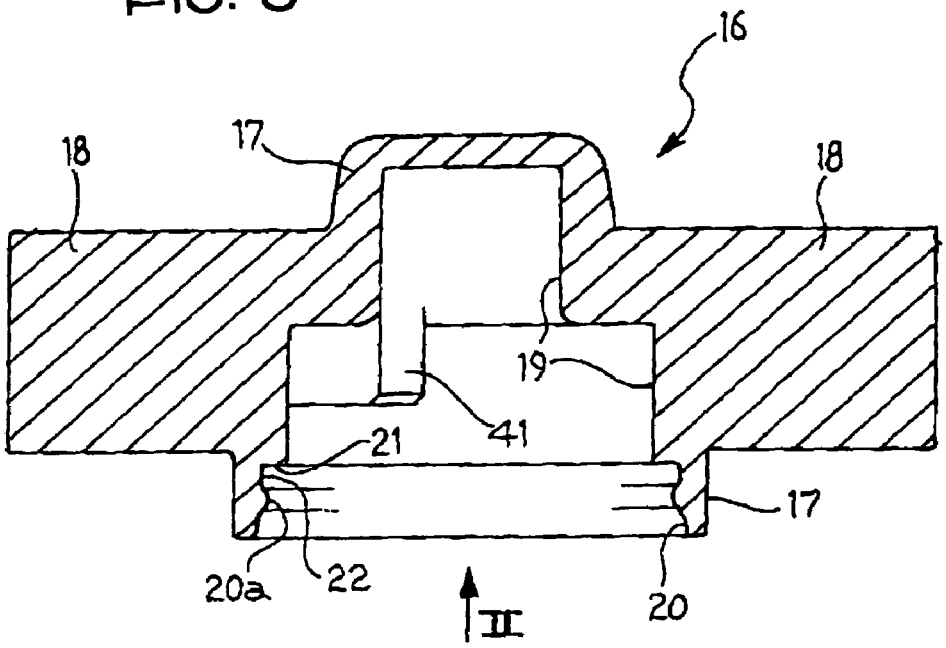
FIGS. 3 and 4 are views sectioned on the lines III—III and IV—IV, respectively, of FIG. 2.
Figure 4:
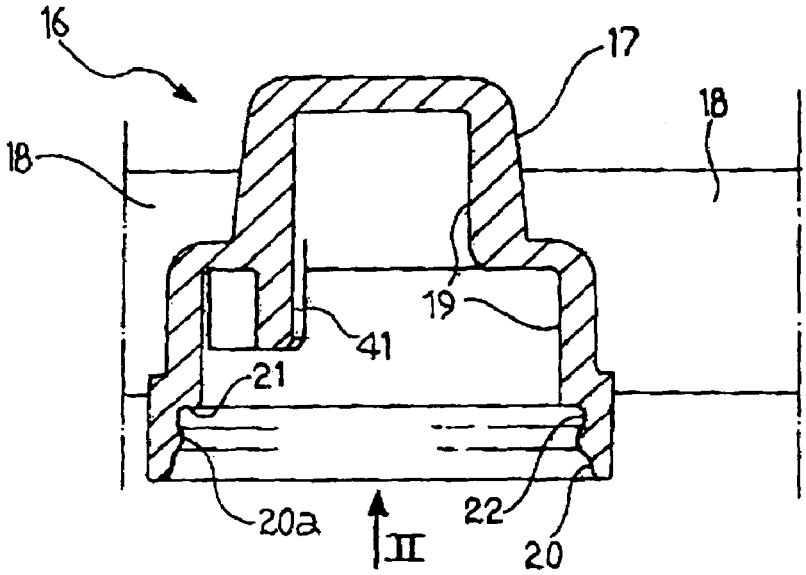

As shown more clearly in FIGS. 2 to 4, in the embodiment illustrated the impeller 16 has a central hub 17 which is substantially in the form of a bell and from which extend externally four radial blades 18 which are equally spaced in an angular manner.

The hub 17 of the impeller 16 has a cavity 19, the mouth 20 of which faces the electrical motor 5. At this mouth, the hub 17 of the impeller 16 has a circumferential bulge 20*a* (see in particular FIGS. 3 and 4) which, together with an annular shoulder 21, defines an annular seat 22 into which a closing element 23 is snapped in the form of an annular disc (FIG. 1) through which the end 9*a* of the rotor shaft 9 extends, with the interposition of a toric sealing ring 24.

The closing element 23 is fixed for rotation with the impeller 16 whereas it is rotatable relative to the shaft 9 of the rotor 7.

The end portion 9*a* of the shaft 9 that extends into the cavity 19 of the impeller 16 is forced with interference into an axial passage 25 defined in a drive body 26 formed from a substantially rigid material, for example polypropylene charged with glass fibres to an extent of from 20% to 40% and preferably of approximately 30%.

The drive body 26 can be seen in particular in FIGS. 5 to 9.

In the embodiment illustrated by way of example in those Figures, the body 26 comprises a substantially tubular portion 27 in which the passage 25 is formed and at one end of which an integral circumferential annular projection 28 is formed.

Figure 5A:
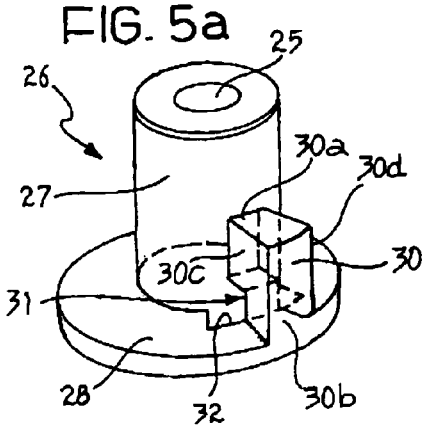
FIG. 5*a* is a perspective view showing a drive body contained in the pump according to FIG. 1.

As shown in particular in FIG. 5*a*, the drive body 26 has a substantially radial integral transverse appendage 30. In the embodiment according to FIGS. 5 to 9, the appendage is substantially in the form of an inverted L, with a first and a second limb 30*a* and 30*b* (FIGS. 5*a* and 9) which are connected to the tubular portion 27 and to the annular projection 28, respectively.

A notch 31 (FIG. 5*a*) is defined between the two limbs 30*a* and 30*b* of the appendage 30.

A slot 32, which extends angularly beyond the opposite lateral surfaces or faces 30*c* and 30*d* of the appendage, is formed adjacent to the appendage 30, in the annular projection 28 of the drive body 26.

The slot 32 has an angular extension of, for example, approximately 90°. On the other hand, the appendage 30 has an angular extension α (FIG. 6) of advantageously from 25° to 55° and preferably of approximately 40°.

Figure 5B:
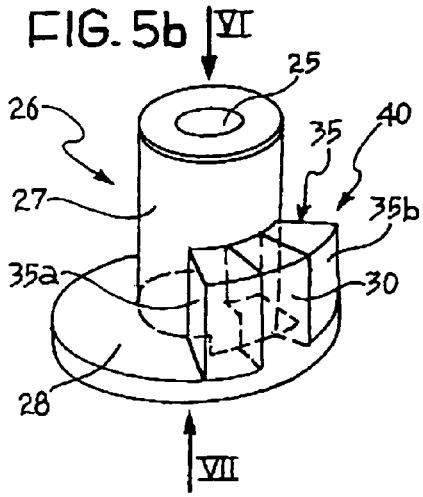
FIG. 5*b* is a perspective view of the drive body according to FIG. 5*a,* provided with a damping formation of resilient material.
Figure 6:
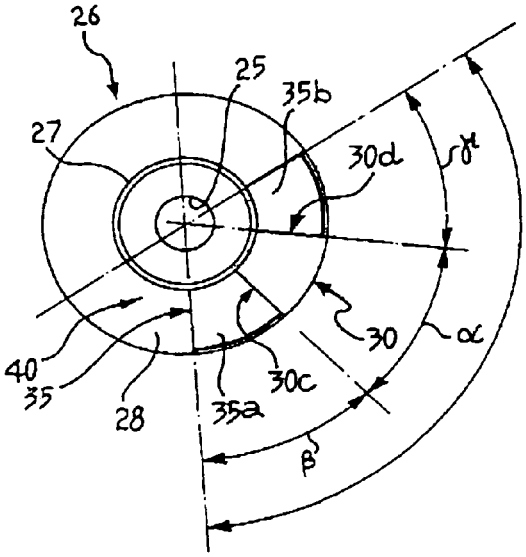
FIGS. 6 and 7 are plan views in the direction of the arrow VI and the arrow VII, respectively, of FIG. 5*b;*
Figure 7:
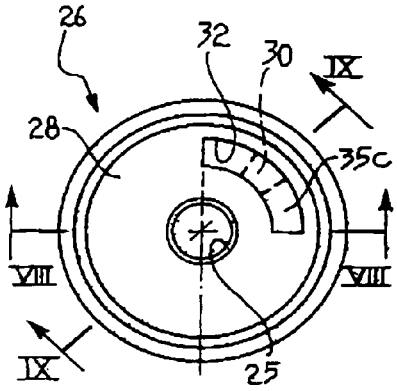
Figure 8:
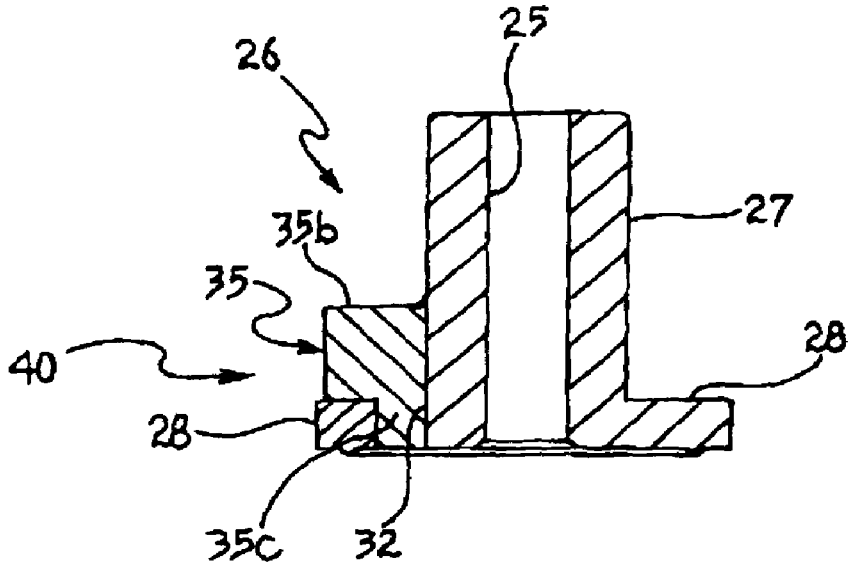
FIGS. 8 and 9 are views sectioned on the line VIII—VIII and the line IX—IX, respectively, of FIG. 7.
Figure 9:
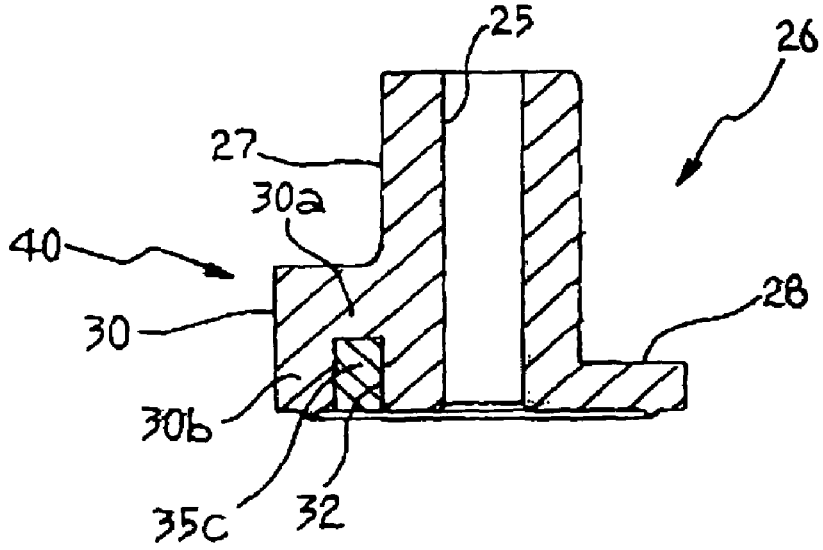
Figure 10:
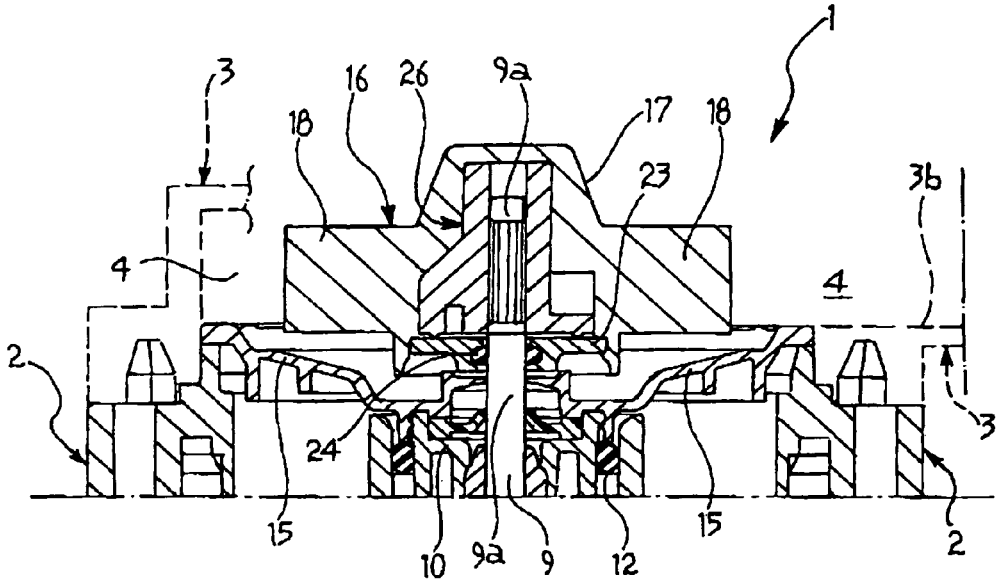
FIG. 10 is a partial view in axial section of another centrifugal pump according to the invention.
Figure 11:
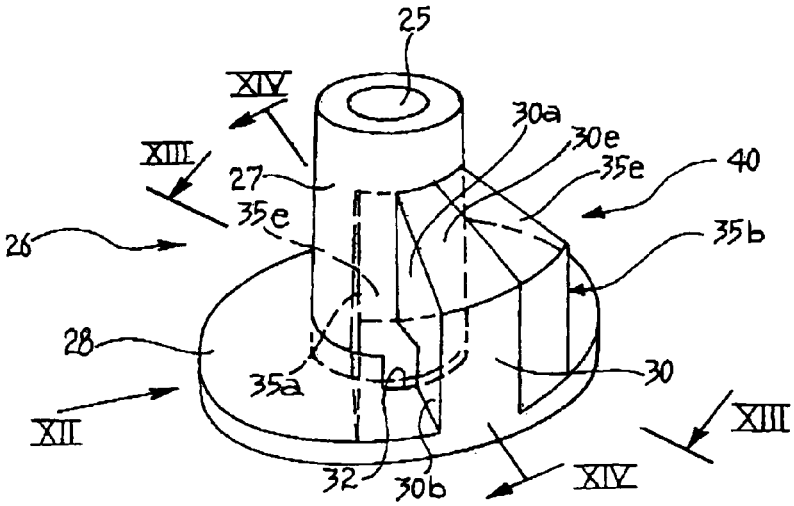
FIG. 11 is a partial perspective view showing a drive body contained in the pump according to FIG. 10.
Figure 12:
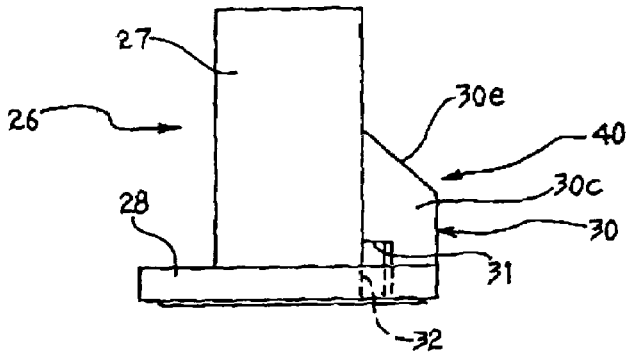
FIG. 12 is a view in lateral elevation in the direction of the arrow XII of FIG. 11.
Figure 13:
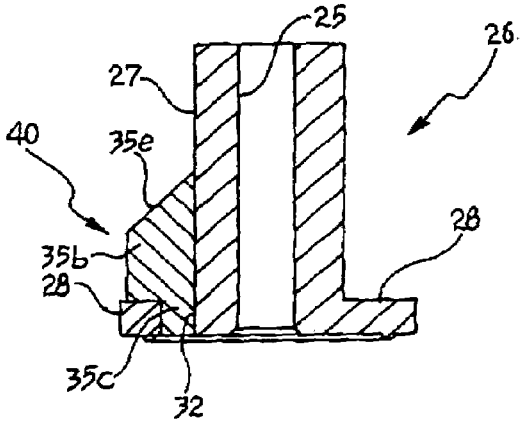
FIGS. 13 and 14 are views sectioned on the line XIII—XIII and the line XIV—XIV, respectively, of FIG. 11.
Figure 14:
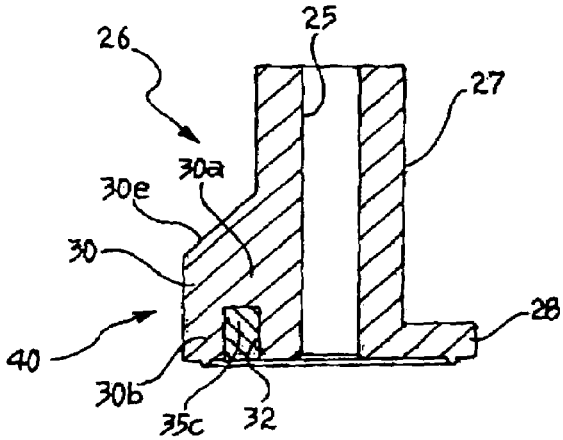

A damping formation of resilient material 35 is molded in a single piece onto the drive body 26 and, in particular, onto the transverse appendage 30 thereof (see in particular FIGS. 5*b* and 6). The damping formation 35 has two end portions 35*a* and 35*b* molded onto the opposite surfaces or faces 30*c* and 30*d* of the appendage 30, and an intermediate connecting and retaining portion 35*c* (see FIGS. 7 to 9) which interconnects the end portions 35*a* and 35*b*, and which extends in the slot 32 and in the passage defined by the notch 31 of the appendage 30.

Advantageously, as shown in FIG. 6, the end portions 35*a* and 35*b* of the damping formation 35 have respective angular extensions β and γ which are equal to one another and which are preferably also equal to the angular extension α of the appendage 30 contained between them. In particular, the end portions of the damping formation likewise advantageously have an angular extension of from 25° to 55° and preferably of approximately 40°.

The monolithic damping formation 35 is constrained in a stable manner, both axially and angularly, on the drive body 26.

As a whole, the appendage 30 of the body 26 and the associated end portions 35*a* and 35*b* of the damping formation 35 constitute a transverse coupling formation which is generally indicated 40 in FIG. 5*b* and the following Figures and which is to cooperate operatively with a coupling formation produced in the cavity 19 of the hub 17 of the bladed impeller 16.

With reference to FIGS. 2 to 4, a coupling formation 41 in the form of an angular sector having an extension δ (FIG. 2), which is advantageously from 45.degree. to 75.degree. and is preferably approximately 60.degree., is produced in the cavity 19 of the hub 17 of the impeller 16.

The coupling formations 40 of the rotor of the electrical motor and 41 of the impeller are produced in such a manner that an angular play is defined between the rotor and the hub of the impeller and is capable, in a manner known per se, of promoting the starting of the electrical motor 5 which, as is well known, generates, on starting, an extremely low couple, as a result of which it has to be started substantially without load. The coupling formations 40 and 41 are also capable of interfering with one another after the starting of the synchronous electrical motor 5 to bring about the drive of the impeller 16 by the rotor 7 of the motor.

When the electrical motor 5 is supplied with alternating voltage, it is equally possible for it to start in the one or the other direction of rotation. However, this is unimportant because the pump 1 is of the centrifugal type. If in the initial direction of rotation the rotor 7 of the motor 5 has to overcome an excessive resisting torque, the direction of rotation is reversed and then, as soon as the coupling formation 40, which is integral with the rotor, strikes against the formation 41 of the impeller, the impeller is driven in rotation. The end portions 35*a* and 35*b* of the damping formation 35 ensure that the impact is damped and that the noise generated as a result of that impact is efficiently reduced.

The damping formation 35 is advantageously produced, for example, from a thermoplastic rubber.

FIGS. 10 to 14 show a variant.

In those Figures, parts and elements which have already been described above have again been given the same alphanumerical symbols for identification.

In the variant according to FIGS. 10 to 14, the appendage 30 of the drive body 26, which is integral with the rotor of the electrical motor, and the end portions 35*a*, 35*b* of the damping formation 35 have, on the side remote from the annular projection 28, respective terminal surfaces 30*e* and 35*e* which are inclined relative to the axis of the drive body 26. As a whole, those terminal surfaces 30*e* and 35*e* form a surface portion which is substantially conical and convex.

The inclination of the terminal surfaces 30*e* and 35*e* relative to the axis of the drive body 26 is advantageously from 30° to 60° and is preferably approximately 45°.

Tests and simulations carried out by and on behalf of the Applicant have indicated that the coupling formation 40 produced as described above with reference to FIGS. 11 to 14 has, in operation, a better distribution of stresses, in particular in the end portions 35*a* and 35*b* of the damping formation 35.

Naturally, the principle of the invention remaining the same, the forms of embodiment and details of construction may be varied widely with respect to those described and illustrated purely by way of non-limiting example, the invention extending to all embodiments that achieve the same benefits, thanks to the same innovative concepts.

What is claimed is:

1. A centrifugal pump, for electrical household appliances, comprising:

a support casing including a body and a volute which are coupled to one another to define a working chamber, a synchronous electrical motor driven by alternating current, having a stator which is stationary relative to the body, and having a permanent magnet rotor which is rotatable in the body, and a bladed impeller mounted rotatably in the working chamber and provided with a hub which has a cavity; the impeller being coupled to an end of the rotor which extends into the cavity of the hub of the impeller;

wherein said end of the rotor and the hub of the impeller are provided with a first and a second transverse coupling formation, respectively, which have respective angular extensions which are predetermined in such a manner that there is angular play, suitable for promoting the starting of the motor, between the rotor and the impeller; the coupling formations being capable of interfering with one another, after the motor has started, in order to bring about the drive of the impeller by the rotor;

wherein the portions of the coupling formation of the rotor that are to cooperate with the coupling formation of the impeller are produced from a resilient material; and wherein the coupling formation of the rotor comprises:

a substantially radial transverse appendage which extends from and is integral with a drive body of substantially rigid material which is secured to the rotor, and a damping formation which is molded in a single piece of resilient material onto the drive body and has two end portions which are molded onto the opposite surfaces or faces of the appendage and which are to engage the coupling formation of the impeller, and an intermediate connecting and retaining portion which interconnects the end portions and extends at least partially through the drive body in such a manner that the damping formation as a whole is constrained in a stable manner, axially and angularly, on the drive body.

2. A centrifugal pump according to claim 1, wherein the drive body comprises a substantially tubular portion suitable for being forced with interference onto an end of the rotor.

3. A centrifugal pump according to claim 1, wherein the drive body has a circumferential annular projection to which the appendage is connected.

4. A centrifugal pump according to claim 3, wherein the appendage has a notch which is adjacent to the tubular portion and to the annular projection of the drive body, with which members it defines a passage in which the intermediate portion of the damping formation extends.

5. A centrifugal pump according to claim 4, wherein the appendage is substantially in the form of an L, with a first and a second limb which are connected to the tubular portion and to the annular projection, respectively, of the drive body.

6. A centrifugal pump according to claim 3, wherein there is formed adjacent to the above-mentioned appendage in the annular projection of the drive body a slot which extends angularly beyond the opposite surfaces or faces of the appendage and in which the intermediate portion of the above-mentioned damping formation extends at least partially.

7. A centrifugal pump according to claim 1, wherein the appendage of the drive body has an angular extension of from 25° to 55°.

8. A centrifugal pump according to claim 7, wherein the end portions of the damping formation each have an angular extension of from 25° to 55°.

9. A centrifugal pump according to claim 3, wherein the appendage of the drive body and the end portions of the damping formation on the side remote from the annular projection have respective terminal surfaces which are inclined relative to the axis of the drive body and which, as a whole, form a surface portion which is substantially conical and convex.

10. A centrifugal pump according to claim 9, wherein the inclination of the terminal surfaces relative to the axis of the drive body is from 30° to 60°.

11. A centrifugal pump according to claim 1, wherein the drive body is produced from a synthetic resin, charged with glass fibres to an extent of from 20% to 40%.

12. A centrifugal pump according to claim 1, wherein the damping formation is produced from a thermoplastic rubber.

* * * * *